United States Patent [19]

Williams

[11] Patent Number: 4,616,623

[45] Date of Patent: Oct. 14, 1986

[54] INTERCHANGEABLE SIGHT MOUNT FOR BOWS

[76] Inventor: Paul D. Williams, 9241 Davison, Davison, Mich. 48423

[21] Appl. No.: 559,750

[22] Filed: Dec. 9, 1983

[51] Int. Cl.[4] ..... F41B 5/00

[52] U.S. Cl. ..... 124/87; 33/265

[58] Field of Search ..... 124/87, 23 R, 24 R, 124/88; 33/265

[56] References Cited

U.S. PATENT DOCUMENTS

| | | | |
|---|---|---|---|
| 2,351,103 | 6/1944 | Brown . | |
| 3,120,222 | 2/1964 | Bear . | |
| 3,266,149 | 8/1966 | Powell . | |
| 3,271,863 | 9/1966 | Harrington | 33/265 |
| 3,410,644 | 11/1968 | McLendon . | |
| 3,667,444 | 6/1972 | Depatie et al. . | |
| 4,048,726 | 9/1977 | LeFebvre . | |
| 4,170,071 | 10/1979 | Mann et al. . | |
| 4,179,613 | 12/1979 | Koren . | |
| 4,291,469 | 9/1981 | Weast | 124/87 X |

*Primary Examiner*—Richard J. Apley
*Assistant Examiner*—Robert W. Bahr
*Attorney, Agent, or Firm*—Harness, Dickey & Pierce

[57] ABSTRACT

A bow sight mount which interchangeably mounts a telescopic or an open sight. The mounting bracket includes four primary components. A bow mounting bracket is attached to the bow. A sliding bracket engages the mounting bracket and is laterally adjustable with respect thereto. An intermediate bracket is rotatably attached to the sliding bracket and a sight mounting plate is rotatably attached to the intermediate bracket. This configuration permits the sight mounting plate to be rotated about two perpendicular axes and laterally and vertically. A mount for a telescopic sight or an open sight is attached to the sight mounting plate preferably by threaded fasteners. This system provides the archer with the capability to rapidly interchange sights and provides a high degree of adjustability for any type of sight.

7 Claims, 5 Drawing Figures

INTERCHANGEABLE SIGHT MOUNT FOR BOWS

BACKGROUND AND SUMMARY OF THE INVENTION

This invention relates to an aiming apparatus for archery bows and particularly to a mounting system which may interchangeably mount a telescopic or open type sighting elements and which is highly adjustable for different uses and usage conditions.

It is frequently desirable to incorporate aiming systems with archery bows in order to increase their accuracy. Numerous approaches for providing enhanced aiming accuracy of bows have been previously employed. Numerous designs of open type sights are currently available for use with archery bows. These sights normally comprise a pin or other sighting member fixed to the bow which the archer lines up with the intended target in order to provide bow aiming. Telescopic sights for bows are also known. Mounts for such sights support the tubular optical sighting instrument and provide an adjustment of the positioning and aiming of the telescopic sights. A particular archer may choose to use either of these types of aiming systems under different circumstances. For instance, a telescopic sight might be preferable for target shooting where high accuracy is extremely important and/or where long distances are encountered. However, a telescopic sight might be difficult to use during some hunting conditions when shooting at moving targets due to the difficulty in locating the target using an enlarged image from a telescopic sighting device. Open type sights are generally superior in conditions calling for rapid identification and location of the target, for example, occurring during hunting situations. Open type sights may also be preferable to the user when shooting in low light conditions. As a result, a convertible sight mounting system would be particularly advantageous. For any type of bow sight, a high degree of adjustability is needed to accommodate various individuals and usage situations.

Accordingly, a principal aspect of this invention is to provide a bow mounted sighting system which is easily convertible between a telescopic sight and an open sight enabling archers to quickly change between sighting systems in accordance with their needs or inclinations.

An additional aspect of this invention is to provide a sight mounting system which permits a wide range of adjustment thereby providing means for properly locating the sighting element positions and angular orientations.

The principal aspects of this invention are achieved by providing a bracket assembly having two rotational degrees of freedom enabling the sighting system to be pitched forward and back and rotated from side to side. In addition, means are provided to vary the position of the sighting element vertically and laterally with respect to the bow. A telescopic or open sight is attached to the mounting system disclosed herein and either may be adjusted in the directions mentioned. An open sight comprising an elongated bracket having spaced sighting elements is also disclosed.

Additional benefits and advantages of the present invention will become apparent to those skilled in the art to which this invention relates upon a reading of the described preferred embodiments of this invention taken in conjunction with the accompanying drawings.

DETAILED DESCRIPTION OF THE INVENTION

Figure 1:
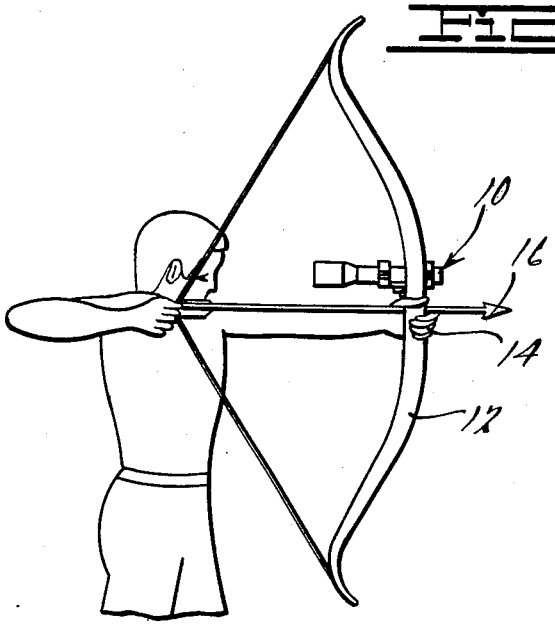
FIG. 1 is a diagramatic view showing a bow sight mount in accordance with the principles of this invention attached to a bow and mounting a telescopic sight. The system is shown by this Figure in use by an archer.
Figure 3:
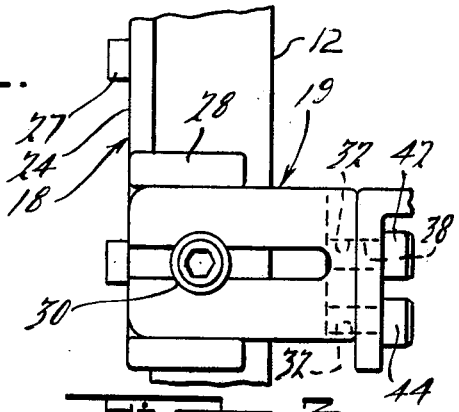
FIG. 3 is a partial front view of the bow sight mount according to this invention particularly showing the means for adjusting the lateral position of a telescopic sighting element.
Figure 2:
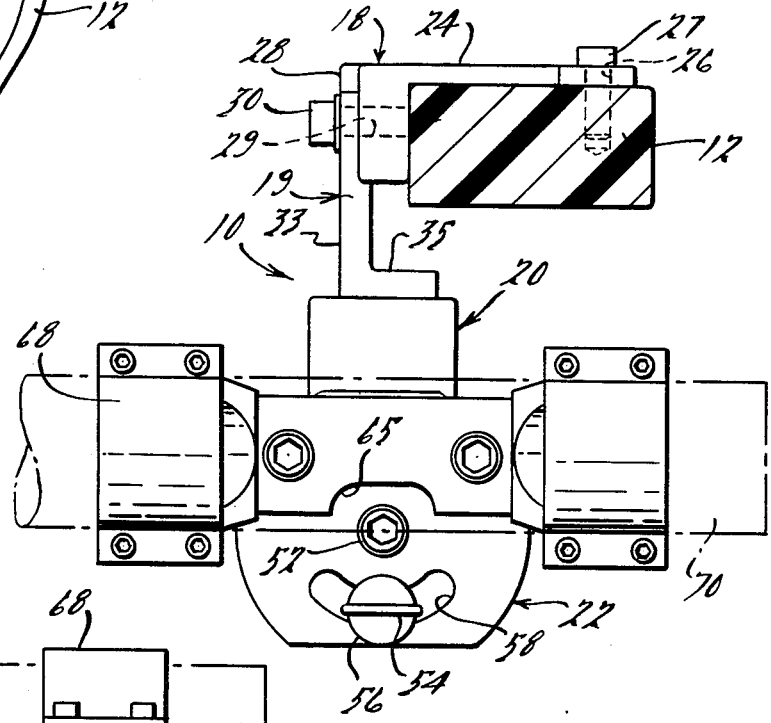
FIG. 2 is a top elevational view of the bow sight according to this invention shown mounting a telescopic sighting device.
Figure 4:
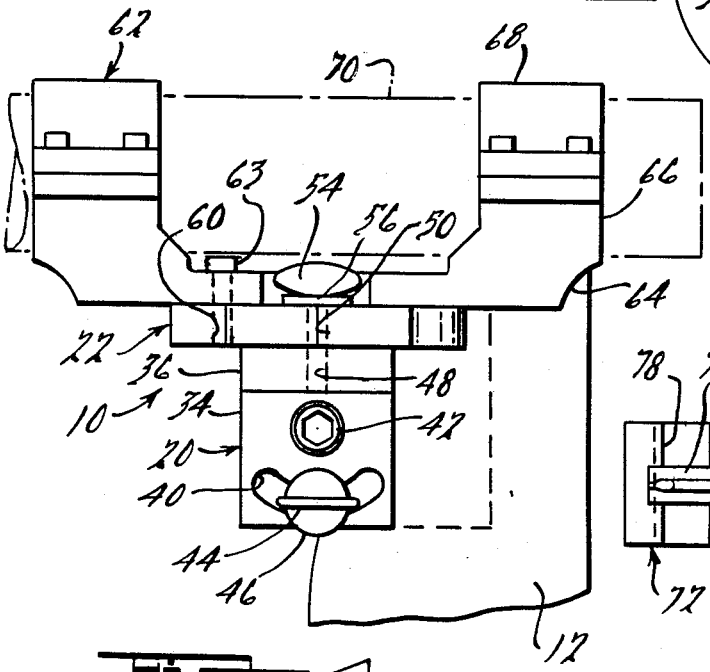
FIG. 4 is a side elevational view of the sighting system according to this invention shown mounting a telescopic sighting device.

An interchangeable bow sight mount according to this invention is shown by FIGS. 1 through 4 and is generally designated by reference character 10. As shown in FIG. 1, bow sight mount 10 is affixed to archery bow 12 such that the aiming axis of the sighting apparatus attached to mount 10 is substantially aligned with the user's eye when arrow 16 is drawn as shown in FIG. 1. As is evident from the Figure, the orientation of the aiming axis of the sighting apparatus is fixed by mount 10. Therefore, the archer is not required to maintain a fixed orientation between the drawn arrow 16 and his sighting eye which is necessary when a single point of aiming reference is employed. Aiming systems defining an aiming axis provide enhanced accuracy over single point aiming systems particularly when used by inexperienced users. FIGS. 2, 3 and 4 show the interchangeable bow sight mount 10 in detail.

It is useful to define certain directions in connection with a description of this invention. References to left, right, up, down, vertical, horizontal and lateral are based from the perspective of an archer using the bow when aiming the arrow along a horizontal plane such as is depicted by FIG. 1. The embodiment described herein is useful for a right-handed archer, i.e., one who draws the bowstring with the right hand. A left-handed equivalent to this novel bow sight mount is constructed by employing components which are mirror image reproductions of those described herein.

Bow sight mount 10 is composed of four primary components—bow mounting bracket 18, sliding bracket 19, intermediate bracket 20 and sight mounting plate 22.

Bow mounting bracket 18 is best described with reference to FIGS. 2, 3, and 4. Bow mounting bracket 18 is L-shaped in section comprising two perpendicular legs. First leg 24 forms several mounting slots 26 adapted to receive threaded fasteners 27 affixing bow mounting bracket 18 to bow 12. Slots 26 are oriented such that they extend vertically, thereby permitting adjustment of the vertical position of mount 10 with respect to bow 12. Such adjustment is necessary in order to compensate for the trajectory of an arrow over various target ranges. First leg 24 of bow sight mounting bracket 18 is attached to the right side of the bow as shown by FIG. 2. Second leg 28 of bow mounting bracket 18 extends across the front of bow 12 from first leg 24 and forms a channel extending laterally across the front of bow 12. Bore 29 is threaded to engage fastener 30 which is employed to affix sliding bracket 19 to bow mounting bracket second leg 28.

Sliding bracket 19 is also "L" shaped in configuration having first and second legs 33 and 35 respectively. First leg 33 forms an elongated slot 37 which permits adjustment of the lateral position of sliding bracket 19 with respect to bow mounting bracket 18. This position is adjusted by loosening fastener 30 and sliding bracket first leg 33 within bow mounting bracket second leg 28. In order to provide a means for adjusting the lateral position between brackets 18 and 19 to a predetemined position setting, a graduated scale may be imprinted or attached to one bracket and an index mark imprinted on the other bracket (not shown). Sliding bracket second leg 35 includes a pair of threaded holes 32.

Intermediate bracket 20 also forms an L-shaped section having first leg 34 and second leg 36. First surface 34 includes bore 38 and arc-shaped aperture 40. Bore 38 and aperture 40 are spaced apart the same distance as are holes 32 of sliding bracket 19. A first threaded fastener 42 rotatably mounts intermediate bracket 20 to sliding bracket 19 by engaging one of bow mounting bracket holes 32. A second threaded fastener 44 preferably of the thumb screw variety, passes through washer 46 and engages hole 32 formed by sliding bracket 19. The width of arc-shaped aperature 40 is sufficiently great to avoid interference with the threads of fastener 44 and is bounded by portions of the circumference of circles having a center coincident with the center of fastener 42. Therefore, second threaded fastener 44 may be loosened permitting intermediate bracket 20 to be rotated through a limited angular range about first fastener 42 causing fastener 44 to sweep through aperture 40. Sliding bracket second leg 35 may include graduations which align with an index mark on intermediate bracket second leg 36 such that the rotational orientation of these parts may be reset after adjustment to a particular position. Intermediate bracket second leg 36 forms two threaded holes 48.

Sight mounting plate 22 forms central hole 50 through which threaded fastener 52 rotatably mounts the mounting plate to intermediate bracket 20. Second fastener 54, preferably of the thumb screw variety, passes through washer 56 engaging another of threaded holes 48. Second fastener 54 passes through an arc-shaped aperture 58 formed by plate 22. Aperture 58 is shaped as described in connection with aperture 40 above thereby allowing plate 22 to be rotated through a limited range about fastener 52. The orientation of plate 22 with respect to intermediate bracket 20 may be set to a preselected value by employing graduations on the components which align with an index mark on the other. Sight mounting plate 22 further includes a plurality of threaded holes 60 which are employed to fix a sighting element to sight mount 10.

A mounting system to affix a telescopic sight to sight mount 10 is shown by FIGS. 1, 2 and 4. Telescopic sight mounting yoke 62 includes a bottom plate 64 having holes therein matching holes 60 formed by sight mounting plate 22 enabling yoke 62 to be affixed to the mounting plate by fastener 63. Bottom plate 64 forms a relieved portion 65 necessary to prevent interference with fastener 52. Mounting yoke 62 further forms a pair of arcuate scope nesting portions 66. Caps 68 threadably engage nesting portion 66 to firmly clamp telescopic sight 70 to yoke 62. Telescopic sight 70 is an optical aiming system including an internal recticle preferably with internal means for slightly moving the optical axis of the device with reference to yoke 62. Telescopic sight 70 is the type which forms an objective image a substantial distance from the eye piece such as is commonly used with pistols. A substantial amount of relief is necessary in that the archer's eyes are located some distance from sight 70 during use. The orientation of sight 70 with respect to bow 12 may be adjusted by rotating intermediate bracket 20 with respect to sliding bracket 19 thereby causing the sight to pitch forward and rearward and may be adjusted by rotating mounting plate 22 with respect to intermediate bracket 20 thereby causing sideways rotation of sight 70. Finally, the lateral and vertical position of the sight is adjustable by loosening and tightening fasteners 30 and 27 respectively.

Figure 5:
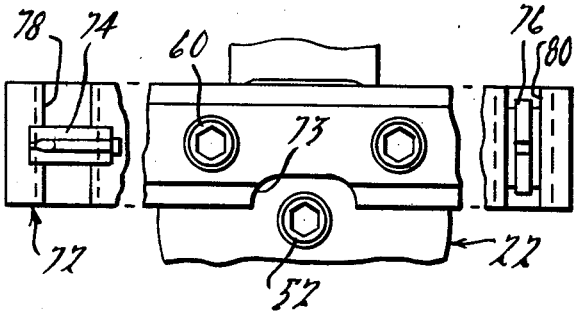
FIG. 5 is a top elevational view of an open sight mounted to the interchangeable sight mounting bracket according to this invention.

Open sight 72 is shown by FIG. 5 attached to sight mounting plate 22 using threaded fasteners 63. Open sight 72 is an elongated plate structure having sighting element mounted within dovetail grooves 78 and 80 at spaced ends of the sight. Disposed within grooves 78 and 80 are front mounted pin type sighting element 74 and rear mounted notched blade 76 which, when lined up, defines an aiming axis. Open sight 72 forms a relieved portion 73 necessary in order to prevent interference with fastener 52. As was explained in connection with telescopic sight 70, open sight 72 may be adjusted for the individual user. Since open sight 72 includes a pair of spaced sighting elements, a sighting axis is defined which does not require precise positioning of the archer's eye with respect to the bow, thereby enhancing accuracy. Open sight 72 is adjustable in the same manner as sight 70 described above.

In use, bow sight mount 10 may be quickly converted from use in connection with a telescopic sight 70 to use with an open sight 72 and vice versa simply by loosening threaded fasteners 63. A predetermined orientation of each of these sights may be achieved quickly with reference to angular and linear reference marks formed at the intersection between the sight mount parts which are rotatable and slide with respect to one another, as previously detailed.

While preferred embodiments of the invention have been described herein, it will be appreciated that various modifications and changes may be made without departing from the spirit and scope of the appended claims.

I claim:

1. A mount for an archery bow which may interchangeably be employed to mount different sights comprising:

a bow mounting bracket affixed to the bow, said bow mounting bracket having at least one slot for enabling the vertical position of said bow mounting bracket to be adjusted with respect to the bow;

a sliding bracket slidably affixed to said bow mounting bracket, a slot in said sliding bracket for enabling said sliding bracket to slide with respect to said bow mounting bracket;

an intermediate bracket rotatably affixed to said sliding bracket, said intermediate bracket having a limited range of rotation with respect to said sliding bracket about a first axis;

a sight mounting plate having a hole for rotatably attaching said sight mounting plate to said intermediate bracket, said sight mounting plate having a limited range of rotation, with respect to said intermediate bracket about a second axis, and said second axis is perpendicular to said first axis; and means for mounting a sight to said sight mounting plate.

2. A mount for an archery bow which may interchangeably be employed to mount different sights comprising:

a bow mounting bracket affixed to the bow, said bow mounting bracket having at least one slot for enabling the vertical position of said bow mounting bracket to be adjusted with respect to said bow;

a sliding bracket slidably affixed said bow mounting bracket, a slot formed in said sliding bracket for enabling said sliding bracket to slide with respect to said bow mounting bracket;

an intermediate bracket rotatably attached to said sliding bracket; said intermediate bracket having a limited range of rotation with respect to said sliding bracket about a first horizontal axis;

a sight mounting plate having a hole for rotatably attaching said sight mounting plate to said intermediate bracket; said sight mounting plate having a limited range of rotation, with respect to said intermediate bracket about a second axis, and said second axis being perpendicular to said first horizontal axis; and means for mounting a sight to said sight mounting plate.

3. The sight mount for an archery bow according to claim 2 wherein said sight is a telescopic sight and said means for mounting said telescopic sight comprises a yoke adapted to engage said telescopic sight including a plate having a plurality of holes which receive threaded fasteners affixing said plate to said sight mounting plate.

4. A sight mount for an archery bow according to claim 2 wherein said sight is an open sight and said means for mounting said open sight comprises said open sight formed from an elongated structure including a plurality of holes which receive threaded fasteners which affix said open sight to said sight mounting plate.

5. A sight mount for an archery bow according to claim 2 further comprising indicia means for indicating the relative position between said brackets and said mounting plate.

6. A mount for an archery bow which may interchangeably be employed to mount different sights comprising;

a bow mounting bracket affixed to said bow including a first and second leg, bow mounting bracket; said bow mounting basket legs being oriented perpendicularly with respect to one another, said first bow mounting bracket leg forming at least one vertically extending slot enabling the vertical position of said bow mounting bracket with respect to said bow to be adjusted, said second bow mounting bracket leg forming a channel;

a sliding bracket having a first and second leg, said sliding bracket legs being oriented perpendicularly with respect to one another, said first sliding bracket leg forming a slot and engaging said second bow mounting bracket leg channel and slidable therein;

means for affixing said bow mounting bracket to said sliding bracket whereby the extent of engagement therebetween may be varied; intermediate bracket having a first and second leg, said intermediate bracket legs being oriented perpendicularly with respect on one another;

means for affixing said sliding bracket to said intermediate bracket whereby the relative angular orientations may be varied therebetween;

a sight mounting plate;

means for affixing said sight mounting plate to said intermediate bracket whereby the relative angular orientation therebetween may be varied; and means for mounting said sight to said mounting plate.

7. A sight mount for an archery bow according to claim 6 further comprising indicia means indicating the relative position between said bow mounting bracket and said bow, between said bow mounting bracket and said sliding bracket, between said sliding bracket and said intermediate bracket and between said intermediate bracket and said sight mounting plate.

* * * * *